US009170073B2

(12) United States Patent
Mangold

(10) Patent No.: US 9,170,073 B2
(45) Date of Patent: Oct. 27, 2015

(54) RIFLE MOUNTED PEPPER SPRAY DEVICE WITH SLIDE ACTIVATION

(71) Applicant: AR Tactical Options, LLC., Columbia Falls, MT (US)

(72) Inventor: Steven D. Mangold, Eureka, MT (US)

(73) Assignee: AR Tactical Options LLC, Columbia Falls, MT (US)

( * ) Notice: Subject to any disclaimer, the term of this patent is extended or adjusted under 35 U.S.C. 154(b) by 89 days.

(21) Appl. No.: 13/971,612

(22) Filed: Aug. 20, 2013

(65) Prior Publication Data

US 2014/0048561 A1 Feb. 20, 2014

Related U.S. Application Data

(60) Provisional application No. 61/691,168, filed on Aug. 20, 2012.

(51) Int. Cl.
*F41H 9/10* (2006.01)
*F41C 27/00* (2006.01)

(52) U.S. Cl.
CPC . *F41H 9/10* (2013.01); *F41C 27/00* (2013.01)

(58) Field of Classification Search
CPC ..... F41H 9/10; F41H 13/00; B65D 83/205; F41C 27/00
USPC ..... 222/79, 192, 162, 153.11, 183, 402.11; 42/1.08
See application file for complete search history.

(56) References Cited

U.S. PATENT DOCUMENTS

| | | | | |
|---|---|---|---|---|
| 1,269,922 | A | 6/1918 | Gadecki | |
| 3,730,390 | A | 5/1973 | Adrian et al. | |
| 5,397,029 | A * | 3/1995 | West | 222/79 |
| 5,671,559 | A | 9/1997 | Ludaesher et al. | |
| 5,787,628 | A * | 8/1998 | Teetzel | 42/1.08 |
| 5,842,601 | A * | 12/1998 | Pierpoint | 222/1 |
| 5,983,548 | A | 11/1999 | Ludaescher | |
| 6,050,454 | A | 4/2000 | Ludaescher et al. | |
| 6,546,661 | B1 | 4/2003 | Staubs | |
| 6,658,779 | B2 | 12/2003 | Bauer et al. | |
| 7,644,839 | B2 | 1/2010 | McNulty, Jr. | |
| 2002/0184809 | A1 * | 12/2002 | Bauer et al. | 42/1.08 |
| 2006/0120009 | A1 * | 6/2006 | Chudy, II | 361/232 |

* cited by examiner

*Primary Examiner* — Kevin P Shaver
*Assistant Examiner* — Robert Nichols, II
(74) *Attorney, Agent, or Firm* — Jean Kyle

(57) ABSTRACT

A rifle or pistol mounted pepper spray device has a slide activation. The device has a housing that attaches to a picatinny rail of a modern sporting rifle. The housing receives a can of pepper spray. The housing and pepper spray slip into a grip. The grip activates the pepper spray when it is pulled toward the user. The device has a lock system as well as a buffer spring to prevent inadvertent spraying of the pepper spray.

17 Claims, 8 Drawing Sheets

RIFLE MOUNTED PEPPER SPRAY DEVICE WITH SLIDE ACTIVATION

CROSS-REFERENCE TO RELATED APPLICATIONS

This application claims the benefits of U.S. Provisional Patent Application No. 61/691,168, filed Aug. 20, 2012, the disclosure of which is hereby incorporated by reference in its entirety including all figures, tables and drawings.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISC APPENDIX

Not applicable.

BACKGROUND OF THE INVENTION

Whether to use lethal force is a life or death decision made often in a split second. A bear encountered by a hunter or a perpetrator encountered by a SWAT team member are both very unpredictable targets. Currently, once the decision is made to use non-lethal force, a hunter or tactical officer must abandon the lethal option to activate pepper spray. Hip mounted pepper spray requires that the hunter or tactical officer lower his rifle to acquire and apply the spray. Rifle mounted devices often require that the user remove his finger from the trigger of the rifle to activate the spray (see, for example, U.S. Pat. Nos. 1,269,922; 5,671,559; 6,546,661 B1; 6,644,839 B2; and 7,644,839 B2). In either case, the user gives up the option to use lethal force.

A need remains for a device that can dispense pepper spray in these critical situations that is fast and intuitive. The pepper spray could be dispensed by a motion which is familiar to a rifleman. Most importantly, the subject device would not require the user to abandon the option of lethal force by requiring him to remove his finger from the trigger of his rifle.

All patents, patent applications, provisional patent applications and publications referred to or cited herein, are incorporated by reference in their entirety to the extent they are not inconsistent with the teachings of the specification.

BRIEF SUMMARY OF THE INVENTION

A rifle or pistol mounted pepper spray device for defense against animals such as bears, or for tactical use in subduing personnel in SWAT and military situations is disclosed. This device is mounted on a rifle, is slide activated by a motion familiar to a rifleman, and does not require the user to remove his finger from the trigger of the rifle. A housing receives a modified can of pepper spray on which the nozzle has been extended. The housing and pepper spray slide into a grip. The user slides the grip backwards to activate the spray. Safety devices prevent inadvertent release of the pepper spray.

DETAILED DESCRIPTION OF THE INVENTION

The device of the subject invention is rifle mounted, slide activated pepper spray. A pepper spray can is held by a housing which slips into a grip used to activate the spray. The user pulls back on the grip to dispense the spray.

The subject device is activated by sliding the grip of the device toward the user. In some instances, the device is referred to as having a "pump" style activator. Applicant notes however that the "pump" style activator of the subject invention does not require the user pump the device repeatedly since the can holding the pepper spray is pressurized. Applicant refers to the subject device as having a "pump" style activator because the movement required to release the pepper spray is much like the movement used to eject the spent round from the chamber of a pump-action shot gun.

Figure 1:
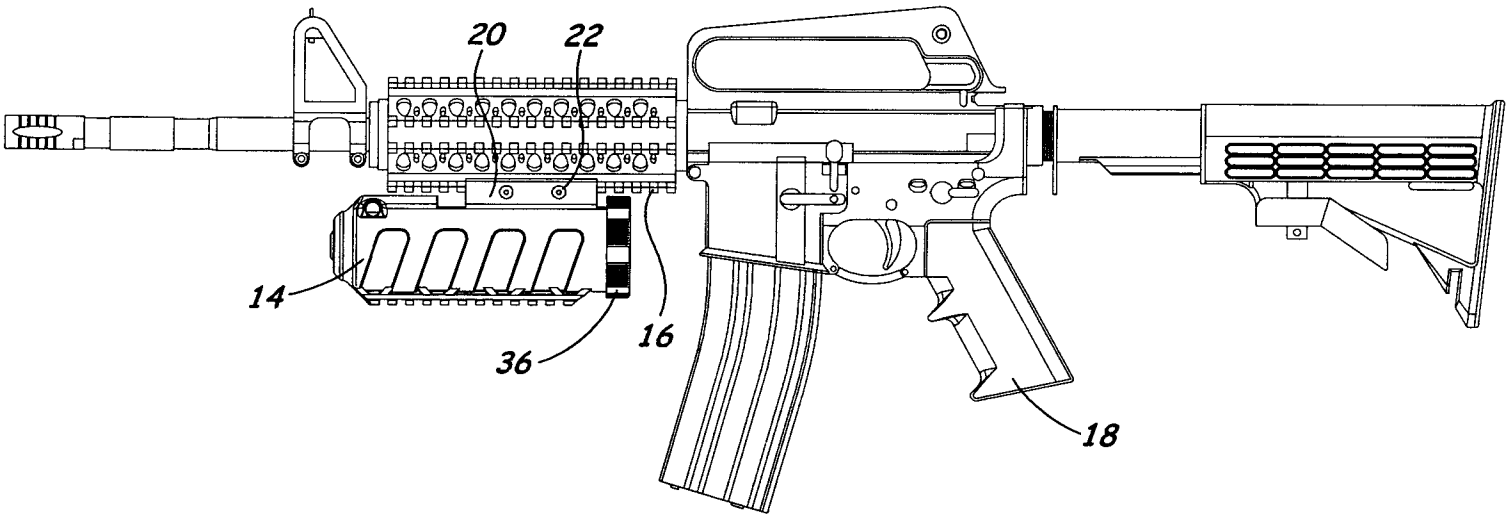
FIG. 1 is a preferred embodiment of the device of the subject invention on a rifle.
Figure 2:
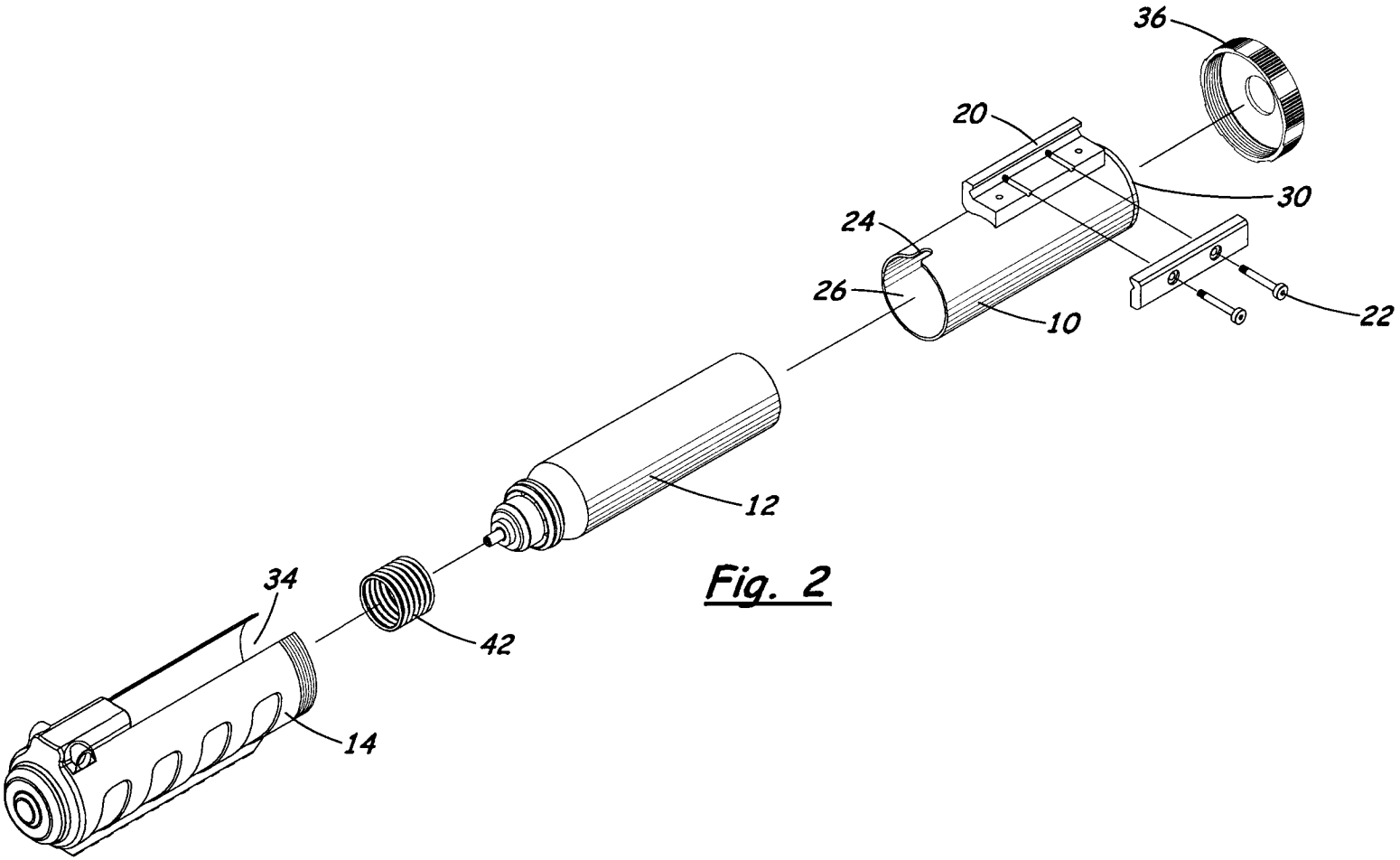
FIG. 2 is an exploded view of a preferred embodiment of the device of the subject invention.
Figure 3:
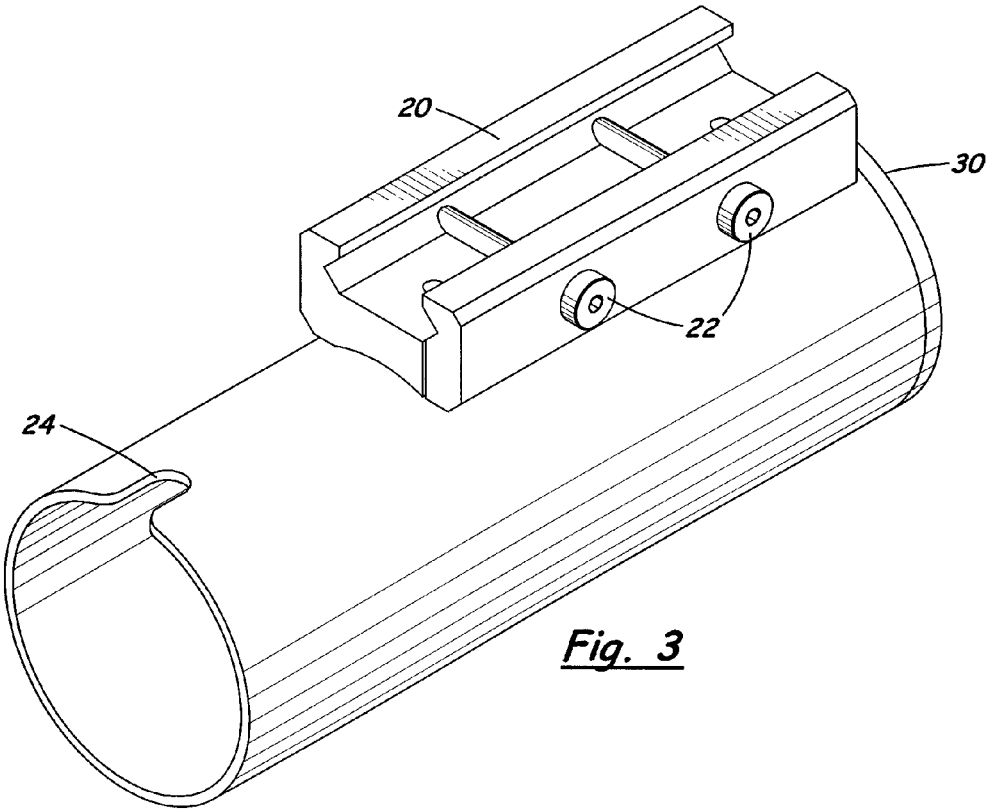
FIG. 3 is a top perspective view of a preferred embodiment of the housing of the device of the subject invention.
Figure 4:
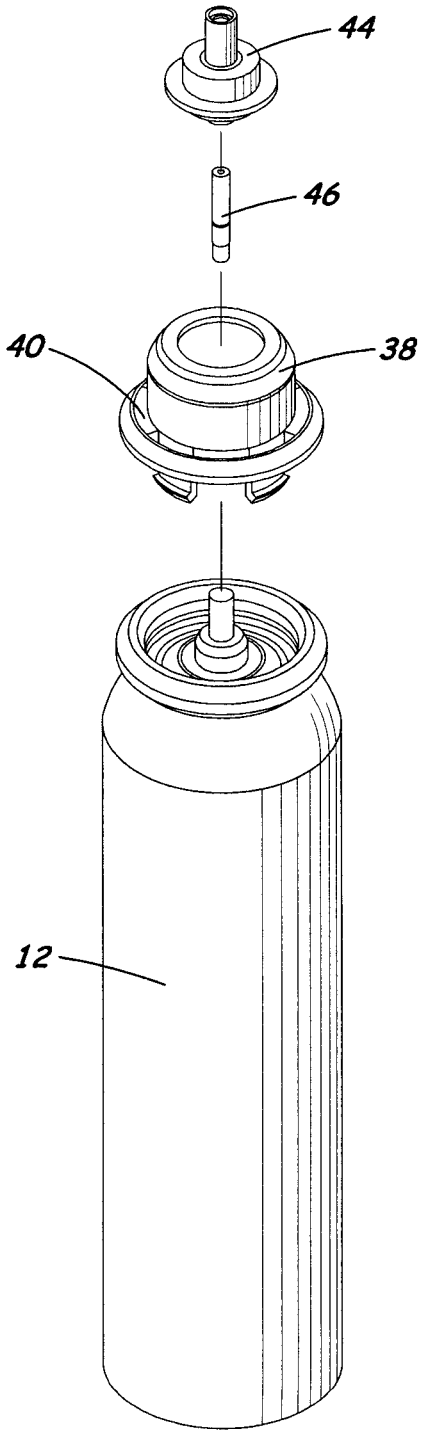
FIG. 4 is an exploded view of a preferred embodiment of the pepper spray can of the device of the subject invention.

Preferred embodiments of device of the subject invention is shown in FIGS. 1-8. These preferred embodiments show the device attached to a Modern Sporting Rifle (MSR) which is also known as an AR or AR-15. Specifically, the subject device attaches to the picatinny rail of the MSR (FIG. 4). Applicant notes however that it would be apparent to one skilled in the art how to mount the device on other types of firearms.

Figure 5:
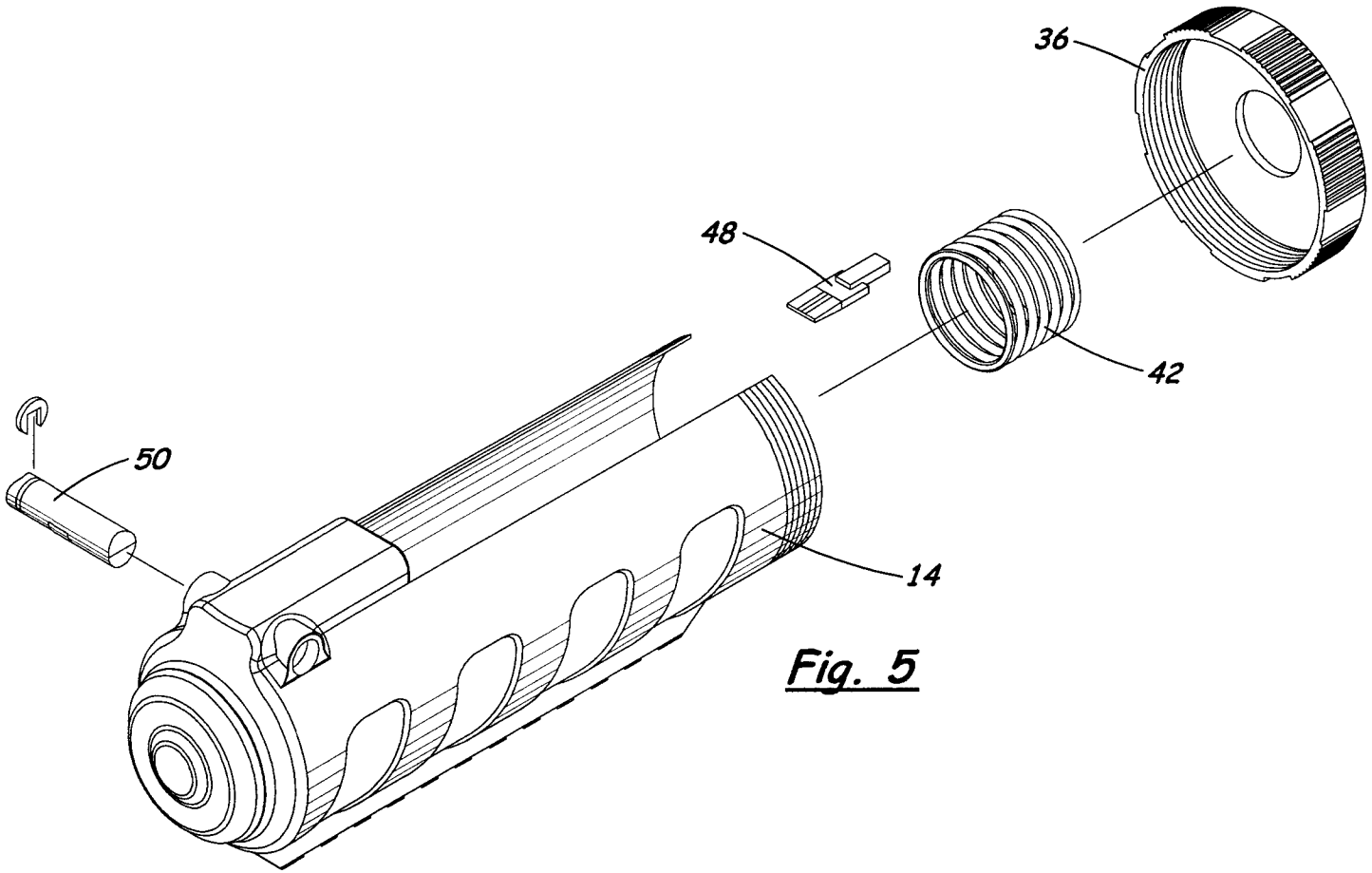
FIG. 5 is an exploded view of a preferred embodiment of the grip of the device of the subject invention.
Figure 6:
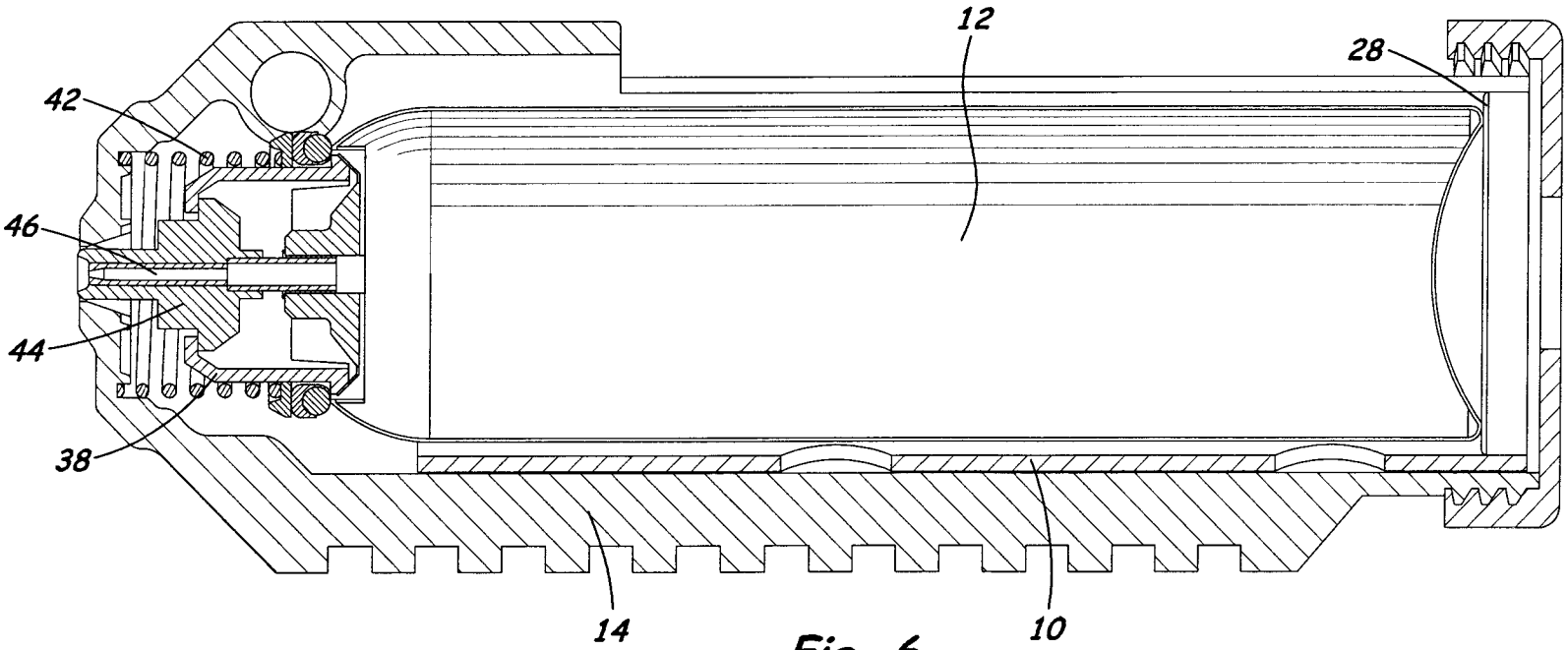
FIG. 6 is a cross-sectional partial view of a preferred embodiment of the device of the subject invention featuring the safety features.
Figure 7:
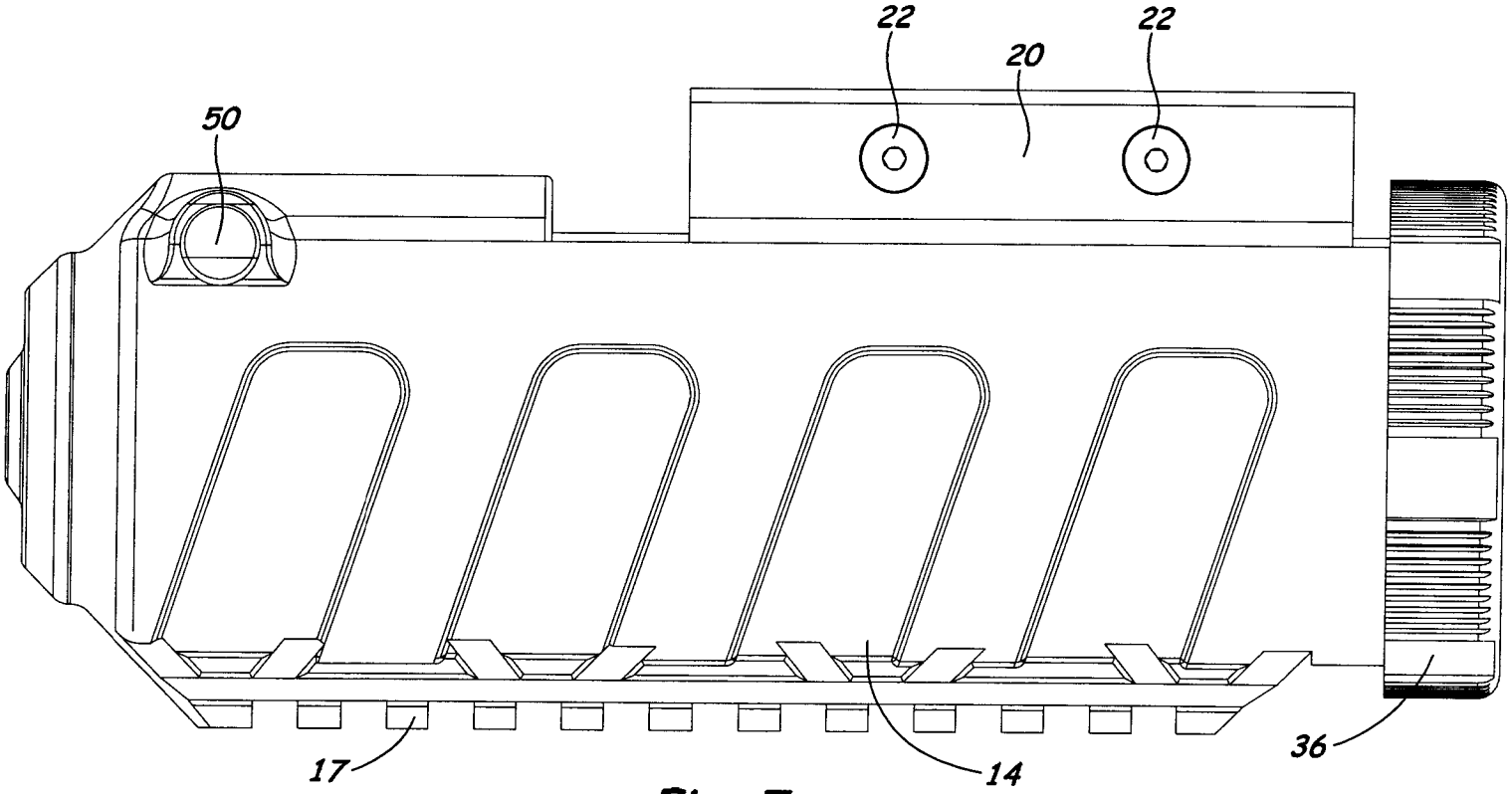
FIG. 7 is a side elevational view of another preferred embodiment of the device of the subject invention.

The exploded view in FIG. 5 shows that slide action pepper spray assembly has a housing 10 to hold a pepper spray can 12 and a grip 14 to activate the pepper spray. In the exemplified embodiment, the housing 10 is adapted to attach to the picatinny rail 16 of a MSR 18. A track 20 connected to the housing captures the rail 16 and is secured to the rail with screws 22 (FIG. 6). A notch 24 in the housing works with one of the several safety devices of the subject invention (FIG. 6). The pepper spray can slips in the housing through its open front end 26. An annular ring 28 in the housing's rear end 30 and opposite the nozzle of the pepper spray holds the can in the housing (FIG. 7). The nozzle 32 of the pepper spray can (FIG. 8) is extended to accommodate the pump style activator (FIG. 9). The modified pepper spray can within the housing slips into the open rear end of the grip 34 (FIG. 10). A cap 36 at the grip's rear end holds the can and housing inside the grip (FIG. 11). The user slides his hand backward, or pulls the grip, to fire the pepper spray.

The nozzle 32 of the pepper spray can is extended to accommodate the pump/slide activator (FIG. 9). The extension assembly comprises a retaining collar 38 that snaps into the can. The collar has a recess 40 in which the buffer spring 42 (described below) of the grip 14 seats. A nozzle extension 44 fits over the nozzle of the pepper spray can. An orifice 46 is placed inside the nozzle extension and acts to direct the pepper spray that is released from the can.

The pump style activator of the pepper spray device of the subject invention has safety systems that prevent the user from firing the pepper spray unintentionally. A safety lock 48 must be disengaged in order for the activator to fire. In one embodiment, the safety lock is a slide lock similar to a lock found on a rifle and engages the notch 24 in the housing of the subject device. The slide tab 50 must be pushed from one side to another to disengage the lock and allow the pepper spray to fire (FIG. 11). In another embodiment, the lock can be associated with the action of activation. For example, when the user places their hand around the grip portion of the activator before the pepper spray will fire the user must first twist the grip to release the lock so the user can slide the grip back to activate the spray.

Finally, a buffer spring 42 is in the grip to prevent unintentional activation of the pepper spray by the pump style activator. The buffer spring requires that to release the pepper spray, once the safety is released, the grip must be pulled back past the spring. The buffer spring prevents the spray from being dispersed should the grip be merely bumped.

Figure 8:
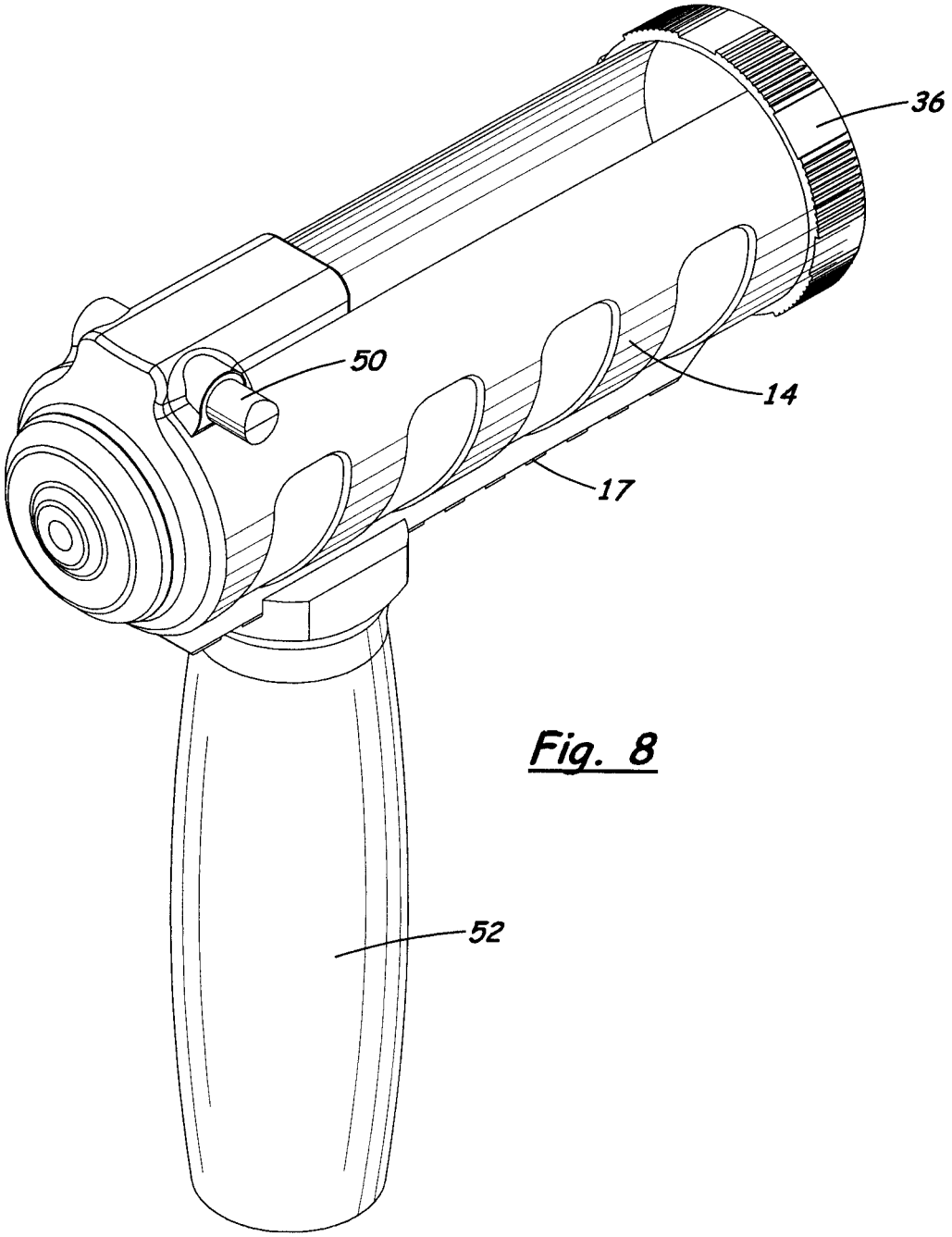
FIG. 8 is a front perspective view of the preferred embodiment shown in FIG. 7 with a handle attached to the lower picatinny rail.

Another preferred embodiment of the device of the subject invention is shown in FIGS. 7 and 8. In this embodiment, a picatinny rail 17 is added to the bottom of the grip 14 portion of the device. The picatinny rail allows the user to attach accessories, including, but not limited to, a handle 52 to steady the device and use in activating the pepper spray, a laser sighting device, or a light.

Components of the device can be made of metal, plastic, or composite material. In the exemplified embodiments, the housing is made from lightweight aluminum, while the grip is made of injection molded plastic. Applicant notes these components however can be made of any material that provides sufficient strength to function on a rifle. Preferably, component material is lightweight to prevent the device from interfering with handling of the rifle.

The rifle mounted pepper spray with slide activation of the subject invention allows the user to keep a finger on the trigger of the rifle and a hand on the grip activator of the pepper spray. Both lethal and non-lethal options therefore remain immediately accessible to the user. The non-lethal option is not only immediately accessible but is intuitive because activation of the pepper spray is executed by the shooter with a familiar pump/slide action. While an advantage of the exemplified device is that the opposite hand of the shooter, the hand not on the trigger, always grips the activator because of its position on the rifle, applicant notes that connecting the subject device to other types of firearms may not allow this positioning of the opposite hand. Therefore, it is anticipated that in some embodiments, the opposite hand will have to be off the grip of the device when holding the firearm. Should this be necessary, it would be desirable to make sure the opposite hand is near the grip so, perhaps, the user need only slide his hand forward from the stock to reach the grip. Another advantage of the subject device is that the pepper spray can be released when the rifle is in any position and is pointed in any direction, 360°. The pepper spray therefore can be activated in tactical situations where the user is ascending or descending a staircase or bent down to look under a bed.

It is understood that the foregoing examples are merely illustrative of the present invention. Certain modifications of the articles and/or methods may be made and still achieve the objectives of the invention. Such modifications are contemplated as within the scope of the claimed invention.

The invention claimed is:

1. A slide activated pepper spray device comprising:

an extension assembly to extend the nozzle of a pepper spray can comprising, a nozzle extension to fit over the nozzle of the pepper spray can, an orifice to direct spray from the pepper spray can, the orifice disposed within the nozzle extension, and a retaining collar directly attached to the pepper spray can to hold the orifice and nozzle extension to the pepper spray can, the retaining collar having a recess;

a housing having an open front end and a rear end, an annular ring disposed in the rear end, and means to affix the housing to an object;

a grip having an open rear end and a front end, the front end having an opening; and a cap;

wherein the pepper spray can with the attached extension assembly slides into the open front end of the housing and the end of the can opposite the extension assembly is held in the housing by the annular ring, the pepper spray can with the attached extension assembly inside the housing slides into the open rear of the grip and is secured within the grip by the cap, the grip configured to move slidably relative to the housing, and whereby the pepper spray is activated when the grip moves relative to the housing and pepper spray is dispensed through an opening in an end of the grip opposite the open rear end.

2. The slide activated pepper spray device of claim 1, further comprising a safety lock.

3. The slide activated pepper spray device of claim 2, wherein said safety lock comprises a slide tab that engages a notch in said housing.

4. The slide activated pepper spray device of claim 1, further comprising a buffer spring seated in said recess of said retaining collar.

5. The slide activated pepper spray device of claim 1, wherein said object is a rifle stock.

6. The slide activated pepper spray device of claim 1, wherein said means to affix said housing to said object is a track capable of engaging a picatinny rail.

7. The slide activated pepper spray device of claim 1, further comprising a picatinny rail for accessories.

8. The slide activated pepper spray device of claim 7, wherein said accessories are selected from the group consisting of a handle, a light, a laser, and a sighting device.

9. A slide activated pepper spray device comprising:

an extension assembly to extend the nozzle of a pepper spray can comprising, a nozzle extension to fit over the nozzle of the pepper spray can, an orifice to direct spray from the pepper spray can, the orifice disposed within the nozzle extension, and a retaining collar directly attached to the pepper spray can to hold the orifice and nozzle extension to the pepper spray can, the retaining collar having a recess;

a buffer spring seated in the recess of the retaining collar;

a housing having an open front end and a rear end and a notch near the open front end, an annular ring disposed in the rear end, and means to affix the housing to an object;

a grip having an open rear end and a front end, the front end having an opening;

a cap; and a safety lock, the safety lock comprising a slide tab that engages the notch in the housing;

wherein the pepper spray can with the attached extension assembly slides into the open front end of the housing and the end of the can opposite the extension assembly is held in the housing by the annular ring, the pepper spray can with the attached extension assembly inside the housing slides into the open rear of the grip and is secured within the grip by the cap, the grip configured to move slidably relative to the housing, and whereby the pepper spray is activated when the grip moves relative to the housing and pepper spray is dispensed through an opening in an end of the grip opposite the open rear end.

10. The slide activated pepper spray device of claim 9, wherein said object is a rifle stock.

11. The slide activated pepper spray device of claim 9, wherein said means to affix said housing to said object is a track capable of engaging a picatinny rail.

12. The slide activated pepper spray device of claim 9, further comprising a picatinny rail for accessories.

13. The slide activated pepper spray device of claim 12, wherein said accessories are selected from the group consisting of a handle, a light, a laser, and a sighting device.

14. A slide activated pepper spray device comprising:

an extension assembly to extend the nozzle of a pepper spray can comprising, a nozzle extension to fit over the nozzle of the pepper spray can, an orifice to direct spray from the pepper spray can, the orifice disposed within the nozzle extension, and a retaining collar directly attached to the pepper spray can to hold the orifice and nozzle extension to the pepper spray, the retaining collar having a recess;

a buffer spring seated in the recess of the retaining collar;

a housing having an open front end and a rear end and a notch near the open front end, an annular ring disposed in the rear end, and means to affix the housing to an object, the means comprising a track capable of engaging a picatinny rail;

a grip having an open rear end and a front end, the front end having an opening;

a cap; and a safety lock, the safety lock comprising a slide tab that engages the notch in the housing;

wherein the pepper spray can with the attached extension assembly slides into the open front end of the housing and the end of the can opposite the extension assembly is held in the housing by the annular ring, the pepper spray can with the attached extension assembly inside the housing slides into the open rear of the grip and is secured within the grip by the cap, the grip configured to move slidably relative to the housing, and whereby the pepper spray is activated when the grip moves back relative to the housing and pepper spray is dispensed through an opening in an end of the grip opposite the open rear end.

15. The slide activated pepper spray device of claim 14, wherein said object is a rifle stock.

16. The slide activated pepper spray device of claim 14, further comprising a picatinny rail for accessories.

17. The slide activated pepper spray device of claim 16, wherein said accessories are selected from the group consisting of a handle, a light, a laser, and a sighting device.

* * * * *